US010036589B2

(12) United States Patent
Hirose et al.

(10) Patent No.: US 10,036,589 B2
(45) Date of Patent: Jul. 31, 2018

(54) APPARATUS AND METHOD FOR PRODUCING LOW-TEMPERATURE COMPRESSED GAS OR LIQUEFIED GAS

(71) Applicant: L'AIR LIQUIDE, Paris (FR)

(72) Inventors: Kenji Hirose, Kakogawa (JP); Shinji Tomita, Hyogo (JP)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 246 days.

(21) Appl. No.: 14/655,261

(22) PCT Filed: Dec. 16, 2013

(86) PCT No.: PCT/EP2013/076745
§ 371 (c)(1),
(2) Date: Jun. 24, 2015

(87) PCT Pub. No.: WO2014/102084
PCT Pub. Date: Jul. 3, 2014

(65) Prior Publication Data

US 2016/0109180 A1 Apr. 21, 2016

(30) Foreign Application Priority Data

Dec. 28, 2012 (JP) ..... 2012-288262
Apr. 15, 2013 (JP) ..... 2013-085114

(51) Int. Cl.
*F25J 1/00* (2006.01)
*F25J 1/02* (2006.01)
(Continued)

(52) U.S. Cl.
CPC ..... *F25J 1/0015* (2013.01); *F01K 25/08* (2013.01); *F25J 1/002* (2013.01); *F25J 1/004* (2013.01);
(Continued)

(58) Field of Classification Search
CPC .. F25J 1/0015; F25J 1/005; F25J 1/052; F25J 1/0057; F25J 1/0221; F25J 1/0222;
(Continued)

(56) References Cited

U.S. PATENT DOCUMENTS 3,183,677 A 5/1965 Hashemi-Tafreshi
3,892,103 A * 7/1975 Antonelli ..... C02F 1/22 60/648

(Continued)

FOREIGN PATENT DOCUMENTS

GB 814 209 6/1959
JP A0545050 2/1993
WO WO 2007 144103 12/2007

OTHER PUBLICATIONS

International Search Report for PCT/EP2013/076745, dated Apr. 28, 2015.

*Primary Examiner* — Keith Raymond
(74) *Attorney, Agent, or Firm* — Justin K. Murray

(57) ABSTRACT

An apparatus and a method for cooling and compressing a fluid to produce a low-temperature compressed fluid that can efficiently use the cold of LNG and reduce the energy needed, the apparatus using a Rankine cycle system having a first compression device, a first heat exchanger, an expansion device, a second heat exchanger, and a first flow passageway for guiding the heat transfer medium from the second heat exchanger to the first compression device; and at least one second compression device that is coupled to the expansion device, wherein at the second heat exchanger, a low-temperature LNG and the heat transfer medium undergo heat transfer, wherein at the first heat exchanger, a fed material gas and the heat transfer medium undergo heat transfer to produce a low-temperature fluid from the material
(Continued)

gas, and the low-temperature fluid is compressed at the second compression device to produce a low-temperature compressed fluid.

2 Claims, 7 Drawing Sheets

(51) Int. Cl.
*F25J 3/04* (2006.01)
*F01K 25/08* (2006.01)

(52) U.S. Cl.
CPC ..... *F25J 1/0012* (2013.01); *F25J 1/0045* (2013.01); *F25J 1/0222* (2013.01); *F25J 1/0224* (2013.01); *F25J 1/0264* (2013.01); *F25J 1/0281* (2013.01); *F25J 1/0285* (2013.01); *F25J 1/0292* (2013.01); *F25J 3/04412* (2013.01); *F17C 2221/033* (2013.01); *F17C 2223/0161* (2013.01); *F17C 2223/033* (2013.01); *F17C 2225/0123* (2013.01); *F17C 2225/035* (2013.01); *F17C 2227/0316* (2013.01); *F17C 2227/0323* (2013.01); *F17C 2227/0393* (2013.01); *F17C 2265/05* (2013.01); *F17C 2270/0136* (2013.01); *F25J 2210/62* (2013.01)

(58) Field of Classification Search
CPC .. F25J 1/0281; F25J 1/0283; F17C 2223/033; F17C 2227/0316; F17C 2227/0323; F17C 2227/0393; F17C 2223/0161; F17C 2265/05
See application file for complete search history.

(56) References Cited

U.S. PATENT DOCUMENTS 4,054,433 A 10/1977 Buffiere et al.
4,444,015 A * 4/1984 Matsumoto ..... F01K 23/04 60/641.1
5,137,558 A * 8/1992 Agrawal ..... F17C 9/04 62/612
8,236,193 B2 * 8/2012 Fukushima ..... C09K 5/045 252/67

* cited by examiner

APPARATUS AND METHOD FOR PRODUCING LOW-TEMPERATURE COMPRESSED GAS OR LIQUEFIED GAS

CROSS REFERENCE TO RELATED APPLICATIONS

This application is a § 371 of International PCT Application PCT/EP2013/076745, filed Dec. 16, 2013, which claims the benefit of JP2012-288262, filed Dec. 28, 2012, and JP2013-085114, filed Apr. 15, 2013, all of which are herein incorporated by reference in their entireties.

TECHNICAL FIELD OF THE INVENTION

The present invention relates to an apparatus and a method for cooling and compressing a fluid to produce a low-temperature compressed fluid using the cold of a liquefied natural gas (hereafter also referred to as "LNG"), and is particularly useful as a technique for liquefying nitrogen gas that is produced by an air separation apparatus or the like.

BACKGROUND

Natural gas (NG) is stored as a liquefied natural gas (LNG) for facility in transportation and storage, or the like, and is used mainly for thermal power generation or for city gas after being vaporized. Then, a technique of effectively utilizing the cold of LNG is developed. Generally, as equipment for liquefying nitrogen gas or the like by using the cold of LNG, a process is used such that nitrogen gas is compressed by a compressor up to a pressure such that the nitrogen gas can be liquefied by heat exchange with the LNG, and subsequently the nitrogen gas is subjected to the heat exchange with the LNG in a heat exchanger to vaporize the LNG by raising the temperature and to liquefy the nitrogen gas.

Also, with respect to the electric power for driving the compressor, the tariff at night is set to be lower than the tariff for daytime, so that a gas liquefying process for efficiently liquefying a gas while taking the fluctuation of the supply amount of the above LNG and the difference in the electric power tariff into consideration is proposed. For example, referring to FIG. 7, there is known a method of liquefying a gas by using the cold of liquefied natural gas by a liquefaction process provided with at least one gas compressor 101, at least one gas expansion turbine 103, and a heat exchanger 102 for performing heat exchange between the gas and the liquefied natural gas, in which the aforesaid expansion turbine 103 is stopped or operated in a decreased amount when the supplied liquefied natural gas increases in amount, while the aforesaid expansion turbine 103 is started or operated in an increased amount when the supplied liquefied natural gas decreases in amount (See, for example, JP-A-05-45050).

However, with an apparatus for producing a low-temperature liquefied fluid or the like such as described above, various problems such as the following occurred in some cases.

(i) The amount of LNG supplied to the gas liquefying process may generally fluctuate due to the fluctuation in the demand for thermal power generation, city gas, or the like, and the amount of cold that can be used may also fluctuate. Therefore, there is a demand for an apparatus or a method by which the cold of LNG can be efficiently used so that the amount of production of the liquefied fluid or the like may not be affected even when the supplied LNG decreases in amount.

(ii) In order to pressurize a gas having a normal temperature and a normal pressure in a process for producing a compressed gas, addition of a large amount of energy and the cold for restraining the gas temperature rise accompanying the compression will be needed. In producing a compressed gas for general use that is consumed in a large amount, such as a nitrogen gas, there is a big problem for an efficient use of the cold and a comprehensive reduction of energy.

(iii) With respect to the temperature at which a gas having a normal pressure starts being liquefied, the temperature is about −80° C. for LNG, while the temperature is about −120° C. for nitrogen. For example, in a process for liquefying nitrogen gas at a normal pressure using LNG as the cold, in a state in which the liquefaction of nitrogen has started, the LNG that is subject to heat exchange with this nitrogen is still in a liquid state having a large latent heat, so that, in view of this process alone, the cold of the LNG is not sufficiently used. Also, it is not necessarily easy to use the cold of the residual LNG for other purposes, so that there is a big problem for an efficient use of energy including the cold of LNG in such a liquefaction process.

SUMMARY OF THE INVENTION

An object of the present invention is to provide an apparatus and a method for cooling and compressing a fluid to produce a low-temperature compressed fluid that can efficiently use the cold of LNG and can reduce the energy that is needed in producing the low-temperature compressed fluid.

The present inventors and others have made eager studies in order to solve the aforementioned problems and, as a result, have found that the aforementioned object can be achieved by an apparatus and a method for producing a low-temperature compressed fluid described below, thereby completing the present invention.

An apparatus for cooling and compressing a fluid to produce a low-temperature compressed fluid according to the present invention using a Rankine cycle system comprises; a first compression device for adiabatically compressing a heat transfer medium; a first heat exchanger for constant-pressure heating the adiabatically compressed heat transfer medium; an expansion device for adiabatically expanding the heated heat transfer medium; a second heat exchanger for constant-pressure cooling the adiabatically expanded heat transfer medium; a first flow passageway for guiding the heat transfer medium from the second heat exchanger to the first compression device; and at least one second compression device that is coupled to the expansion device; wherein, at the second heat exchanger, a low-temperature liquefied natural gas and the heat transfer medium undergo heat transfer, wherein, at the first heat exchanger, a fed material gas and the heat transfer medium undergo heat transfer to produce a low-temperature fluid from the material gas, and wherein, the low-temperature fluid is thereafter compressed at the second compression device to produce a low-temperature compressed fluid.

Also, a method for cooling and compressing a fluid to produce a low-temperature compressed fluid according to the present invention comprises a Rankine cycle system in which a heat transfer medium that has been adiabatically compressed by first compression device is heated in a first heat exchanger at a constant pressure, thereafter adiabatically expanded by expansion device, and further cooled in a second heat exchanger at a constant pressure, wherein a liquefied natural gas in a low-temperature liquefied state is guided into the second heat exchanger to transfer the cold thereof to the heat transfer medium, and a material gas that has been fed is guided into the first heat exchanger to be cooled by the heat transfer medium and thereafter guided into at least one second compression device that is coupled to the expansion device, so as to be extracted as a low-temperature compressed fluid.

With such a structure, the cold of LNG can be efficiently used in preparing a low-temperature compressed fluid, and reduction of needed energy can be achieved. Specifically, in the process of verifying the present invention, it has been found out that the heat transfer is efficiently carried out by heat exchange with a compressed fluid, and the cold needed in preparing a low-temperature gas is extremely small as compared with the cold needed in preparing a low-temperature fluid under conventional conditions of normal pressure using the cold of LNG. Based on such a knowledge, in the present invention, a Rankine cycle system (hereafter also referred to as "RC") that can effectively use the heat exchange with a compressed fluid is applied in preparing a low-temperature fluid, whereby the cold of LNG can be used much more efficiently, and the energy needed in transferring the cold can be reduced to a great extent by efficiently transferring the cold of high-pressure LNG via the heat transfer medium of the RC and transferring the cold energy from the adiabatically compressed heat transfer medium to a fed material gas at normal pressure.

An apparatus according to the present invention using the above-described apparatus further comprises; a second flow passageway for guiding the low-temperature compressed fluid from the second compression device to at least one of the first heat exchanger and the second heat exchanger to form a liquefied component, an adjustment valve for adjusting a pressure of the low-temperature compressed fluid from at least one of the first heat exchanger and the second heat exchanger, and a gas-liquid separator into which the low-temperature compressed fluid is guided via the adjustment valve, performing gas-liquid separation so as to permit the liquefied component to be extracted therefrom.

Also, a method according to the present invention uses the above-described method, wherein the low-temperature compressed fluid from the second compression device is cooled in the first heat exchanger or the second heat exchanger and subjected to pressure adjustment by an adjustment valve, and a liquefied component is subjected to gas-liquid separation in a gas-liquid separator and is extracted as a low-temperature liquefied component from the gas-liquid separator.

When the cold of LNG is used in preparing a liquefied fluid such as nitrogen gas, the temperature of the LNG is around −155° C. while the boiling point of nitrogen under ambient air pressure is −196° C., so that this difference in temperature levels must be compensated between these. The present invention realizes such a function with use of a Rankine cycle system. The heat transfer medium used in the Rankine cycle system is cooled to about −150 to −155° C. by using the cold of LNG to ensure the cold to be transferred to nitrogen gas or the like. After the pressure is raised typically to a critical pressure or above (for example, 5 to 6 MPa), the cold is transferred through the first heat exchanger to the nitrogen gas or the like in a normal pressure or in a low-pressurized condition, and further the cold is transferred through the second heat exchanger to the nitrogen gas or the like compressed to a high pressure, whereby a liquefied nitrogen gas can be efficiently prepared. In preparing a liquefied fluid, the cold of the LNG can be used more efficiently, and the energy needed in transferring the cold can be reduced to a great extent.

The present invention relates also to the apparatus for producing a liquefied fluid described above, wherein the apparatus further comprises: a third heat exchanger disposed in a third flow passageway for guiding the heat transfer medium from the first heat exchanger to the expansion device, wherein the heat transfer medium, the liquefied natural gas from the second heat exchanger, and the low-temperature compressed fluid from the second compression device undergo heat exchange at the third heat exchanger.

With such a structure, the cold of the LNG can be used further more efficiently, and preparation of a liquefied fluid having a high energy efficiency can be carried out. In particular, when cooling water is introduced in the third heat exchanger to perform heat exchange by cold energy having a large heat capacity, transfer of preparatory or auxiliary hot heat to the heat transfer medium, the liquefied natural gas, and the low-temperature compressed fluid can be carried out even to transient fluctuation or the like at the time of starting or at the time of stopping, thereby ensuring a stable use of the cold of LNG and a stable energy efficiency.

The present invention relates also to the apparatus for producing a liquefied fluid described above, wherein first pressure-raising device, a first branching flow passageway, second pressure-raising device, and a second branching flow passageway are disposed in a fourth flow passageway through which the material gas is guided to the first heat exchanger; a fourth heat exchanger and a third branching flow passageway are disposed in a fifth flow passageway through which the liquefied component from the gas-liquid separator is guided; which has a sixth flow passageway through which a gas component from the gas-liquid separator is guided to the first branching flow passageway via the first heat exchanger or the second heat exchanger, and a seven flow passageway through which the liquefied component that has been branched at the third branching flow passageway is guided to the second branching flow passageway via the fourth heat exchanger and the first heat exchanger or the second heat exchanger, where the liquefied component from the gas-liquid separator is extracted therefrom via the fourth heat exchanger.

It is known in the art that, by compressing the material gas in multiple stages, the material gas can be efficiently fed, and the heat exchange efficiency in the heat exchanger into which such a material gas is introduced will be improved. The present invention has made it possible to supply a liquefied fluid in a stable condition and with a good energy efficiency by providing compressors in plural stages as material gas feeding device and returning the liquefied fluid in a stable condition immediately before being extracted to mix the liquefied fluid with the material gas thereof.

The present invention relates also to the apparatus for producing a liquefied fluid described above, wherein the Rankine cycle system is comprised with a plurality of Rankine cycle systems using a plurality of heat transfer media having different boiling points or heat capacities, where the material gas from the first heat exchanger is guided into the first heat exchanger after being compressed by second compression device that is coupled to the expansion device involved in one Rankine cycle system using a heat transfer medium having a low boiling point or a small heat capacity, and thereafter the material gas from the first heat exchanger is guided into the first heat exchanger after being compressed by second compression device that is coupled to the expansion device involved in another Rankine cycle system using a heat transfer medium having a high boiling point or a large heat capacity.

In many cases, an apparatus for producing a liquefied fluid is used in line in semiconductor production equipment or the like, so that a continuous supply of gas is demanded, and also the amount of supply, the pressure of supply, and the like thereof may largely fluctuate. Also, as described before, there are cases in which the stable supply of LNG is not necessarily ensured. The present invention has made it possible to supply a liquefied fluid in a stable condition and with a good energy efficiency by constructing with a plurality of Rankine cycle systems using a plurality of heat transfer media having different boiling points or heat capacities for the heat transfer medium that carries out the transfer of the cold of LNG and adjusting the control elements that can be easily controlled, such as the flow rate and the pressure of the heat transfer medium, in each Rankine cycle system with regard to the fluctuating elements in these cases.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION

An apparatus for cooling and compressing a fluid to produce a low-temperature compressed fluid according to the present invention (hereafter referred to as "present apparatus") using a Rankine cycle system (RC) comprises; a first compression device for adiabatically compressing a heat transfer medium, a first heat exchanger for constant-pressure heating the adiabatically compressed heat transfer medium; an expansion device for adiabatically expanding the heated heat transfer medium; a second heat exchanger for constant-pressure cooling the adiabatically expanded heat transfer medium; a (first) flow passageway for guiding the heat transfer medium from the second heat exchanger to the first compression device; and at least one second compression device that is coupled to the expansion device; wherein, at the second heat exchanger, a low-temperature liquefied natural gas (LNG) and the heat transfer medium undergo heat transfer, wherein, at the first heat exchanger, a fed material gas and the heat transfer medium undergo heat transfer to produce a low-temperature fluid from the material gas, and wherein, the low-temperature fluid is thereafter compressed at the second compression device to produce a low-temperature compressed fluid. Hereafter, the embodiments of the present invention will be described with reference to the attached drawings. Here, in the present embodiments, cases in which nitrogen gas is the gas to be liquefied may be exemplified; however, the present invention can be applied similarly to liquefaction of other gases, for example, air, argon, and the like. Also, conditions such as the temperature, the pressure, and the flow rate of each section can be suitably changed in accordance with other conditions such as the type of the gas and the flow rate.

Figure 1:
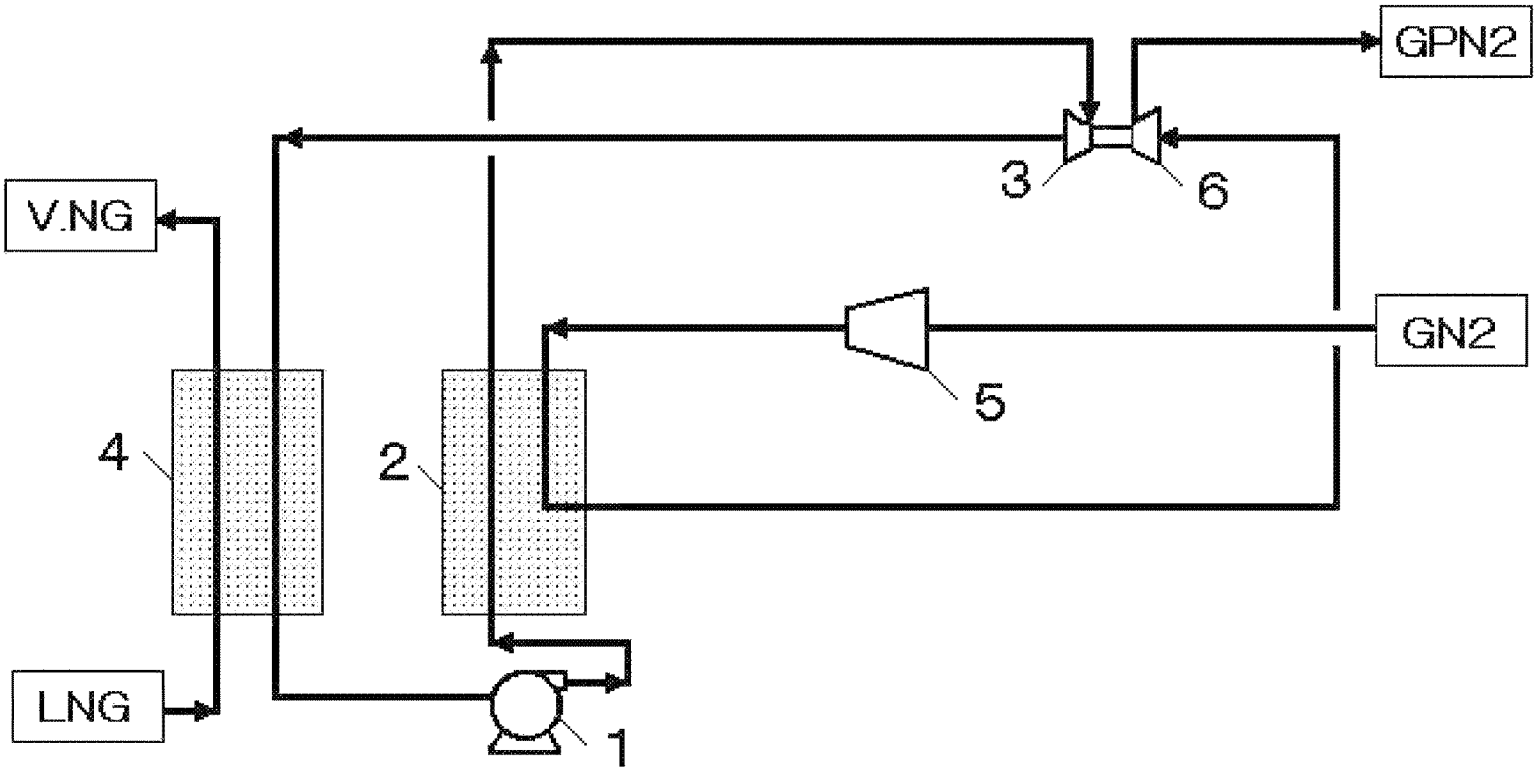
FIG. 1 is a schematic view illustrating a basic exemplary structure of an apparatus for cooling and compressing a fluid to produce a low-temperature compressed fluid according to an embodiment of the present invention.

The basic structure of the present apparatus will be schematically exemplified in FIG. 1. The present apparatus has a Rankine cycle system (RC) in which a heat transfer medium circulates. The heat transfer medium forms a circulation system in which, sequentially, the heat transfer medium is adiabatically compressed by a compression pump 1 which serves as a first compression device, constant-pressure cooled by a material gas in a first heat exchanger 2, adiabatically expanded by a turbine 3 which serves as an expansion device, constant-pressure cooled by the cold of LNG in a second heat exchanger 4, and sucked again by the compression pump 1. By such a structure, the cold of LNG can be stably and efficiently transferred to the material gas. Here, the "heat transfer medium" may be selected from among various substances such as hydrocarbon, liquefied ammonia, liquefied chlorine, and water. Also, at a normal temperature and under a normal pressure, the heat transfer media may include not only liquids but also gases, so that a gas having a large heat capacity, such as carbon dioxide, may be applied. Besides the case in which methane, ethane, propane, butane, or the like is used singly as the hydrocarbon, the optimum boiling point or heat capacity can be designed by using a mixture of a plurality of compounds. In particular, when a plurality of RCs are used as will be described later, the cold energy of LNG can be thermally transferred in a plurality of temperature bands by using, for example, a mixture of "methane+ethane+propane" in one RC and using a mixture of "ethane+propane+butane" in another RC.

The LNG of a predetermined flow rate is supplied to the second heat exchanger 4, whereby a predetermined amount of cold is ensured. By controlling the supply flow rate of the LNG, the cold that is transferred to the material gas can be easily adjusted. A material gas of a desired flow rate is supplied to the first heat exchanger 2 by a feed pump 5, whereby a predetermined amount of cold is transferred to the material gas to cool the material gas to a desired temperature. Further, the material gas is guided into the compressor 6 which is second compression device so as to be compressed to a desired pressure and is extracted as a desired low-temperature compressed fluid. By such a structure, a desired low-temperature compressed fluid can be produced in a stable condition. Also, the energy efficiency can be improved to a great extent as compared with a conventional apparatus in which the cold of LNG and the material gas are subjected to direct heat exchange.

As described above, the low-temperature compressed fluid is produced in such a condition that, in the present apparatus in which a Rankine cycle system (RC) is formed, a liquefied natural gas in a low-temperature liquefied state is guided into the second heat exchanger 4 to transfer the cold thereof to the heat transfer medium, and the material gas that is fed by the feed pump 5 is guided into the first heat exchanger 2 to be cooled by the heat transfer medium and thereafter guided into at least one second compression device (compressor) 6 that is coupled to the expansion device (turbine) 3, so as to be extracted as a low-temperature compressed fluid.

Specifically, an example will be assumed in which a mixture obtained by blending ethane and propane in an equal molar ratio as a major component, for example, is used as the heat transfer medium of the RC; LNG of about 6 MPa is guided into the second heat exchanger 4; and nitrogen gas is fed as a material gas. In the example, the heat transfer medium guided at about 0.05 MPa into the second heat exchanger 4 is guided out after being cooled to about −115° C., adiabatically compressed to about 1.8 MPa by the compression pump 1, guided into the first heat exchanger 2, guided out after being heated by heat exchange with the material gas, adiabatically expanded by the turbine 3, and guided at about −45° C. and under about 0.05 MPa into the second heat exchanger 4. The nitrogen gas guided at about 2.1 MPa into the first heat exchanger 2 is guided out after being cooled to about −90° C., compressed to about 5 MPa by the compressor 6 coupled to the turbine 3, and extracted as a low-temperature compressed nitrogen gas having a temperature of about −90° C. and a pressure of about 5 MPa.

A case in which a low-temperature compressed nitrogen gas was prepared using the present apparatus was compared with a case in which a low-temperature compressed nitrogen gas was prepared using a conventional method, so as to verify the energy efficiency thereof. As will be described below, an improvement of about 50% or more could be achieved by using the present apparatus.

(i) A case in which a low-temperature compressed nitrogen gas was prepared using a conventional method Assuming that LNG was supplied at 1 ton/h and a compressor was operated at an electric power of 15.7 kWh, a nitrogen gas of 677 $Nm^3/h$, for example, could be pressurized from 20 bar to 37 bar. During this time, the entrance temperature of the compressor was 40° C., and the exit temperature thereof was 111° C.

(ii) A case in which a low-temperature compressed nitrogen gas was prepared using the present method The amount of LNG needed to obtain a similar low-temperature compressed nitrogen gas, that is, to pressurize a nitrogen gas of 677 $Nm^3/h$ from 20 bar to 37 bar, was 0.485 ton/h.

(iii) When the two cases were compared, it had been found out that the electric power could be reduced by about 8 kWh, that is, by about 52%, from the following formula 1.

$$(1-0.485)\times 0.515=8.09\ [\text{kWh}]$$

$$8.09/15.7=0.52 \qquad \text{(formula 1)}$$

Apparatus for producing a liquefied fluid using the present apparatus

Figure 2:
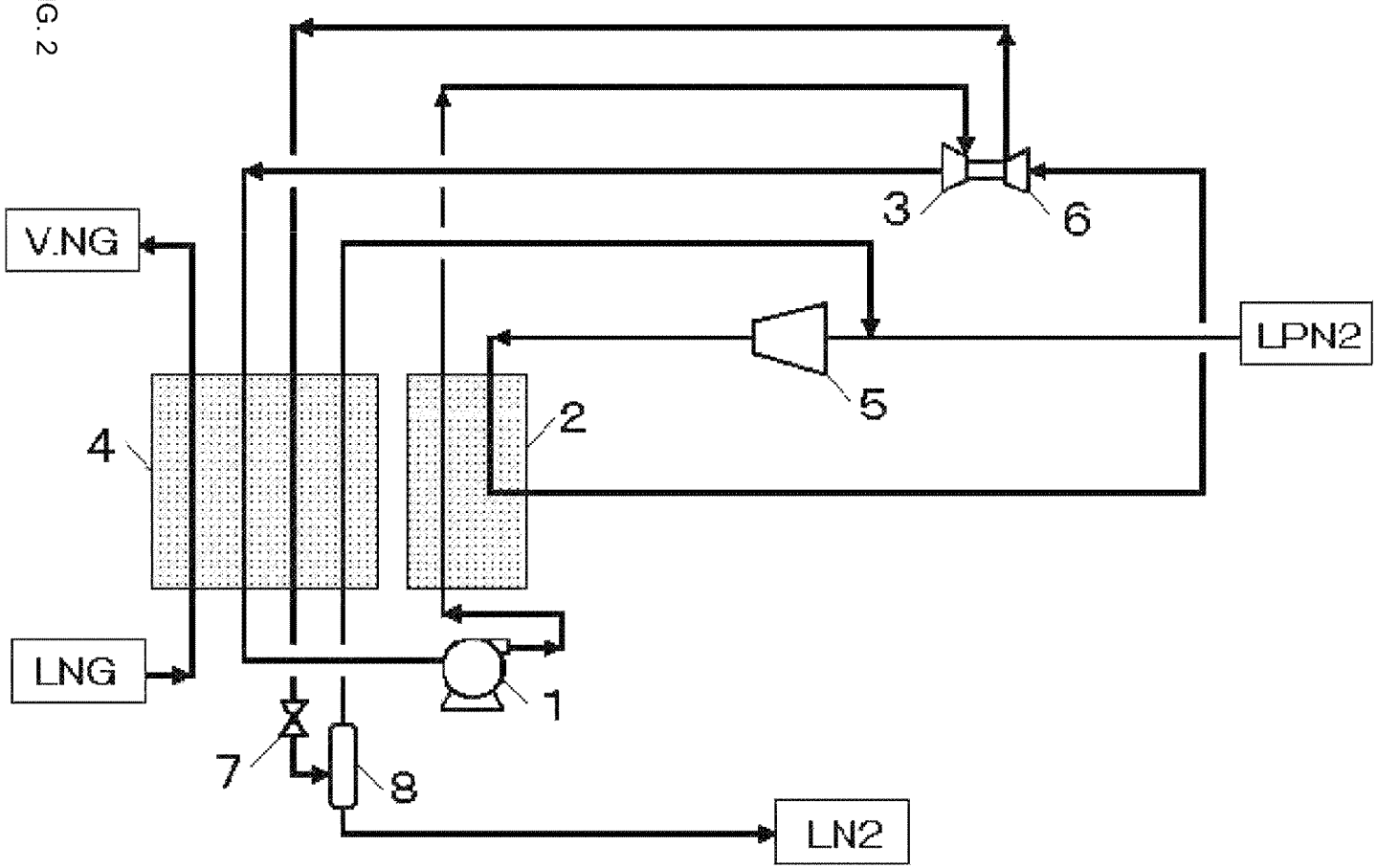
FIG. 2 is a schematic view exemplifying one mode of the first exemplary structure of an apparatus for producing a liquefied fluid according to an embodiment of the present invention.

A basic exemplary structure (first exemplary structure) of an apparatus (hereafter referred to as "present liquefaction apparatus") for producing a liquefied fluid using the present apparatus will be schematically shown in FIG. 2. Hereafter, elements common to those of the present apparatus will be denoted with common nominations and reference symbols, and a description thereof may be omitted. The present liquefaction apparatus has a Rankine cycle system (RC) similar to that of the present apparatus and comprises a (second) flow passageway through which the low-temperature compressed fluid from the second compression device 6 to at least one of the first heat exchanger 2 and the second heat exchanger 4 (the second heat exchanger 4 in the first exemplary structure), an adjustment valve 7 for adjusting the pressure of the low-temperature compressed fluid containing a liquefied component from the first heat exchanger 2 or the second heat exchanger 4 (from the second heat exchanger 4 in the first exemplary structure), and a gas-liquid separator 8 into which the low-temperature compressed fluid is guided via the adjustment valve 7 so as to perform gas-liquid separation of the liquefied component, whereby the low-temperature liquefied component from the gas-liquid separator 8 is extracted. In addition to the functions in the above-described present apparatus, the difficulty of heat transfer due to the difference between the temperature of the supplied LNG and the boiling point of the material gas can be eliminated by effectively using the RC. In other words, by transferring the cold of the LNG further to the compressed low-temperature gas, the cold can be efficiently used for liquefying the low-temperature gas. By such a structure, the liquefied fluid can be prepared stably and efficiently.

Figure 3:
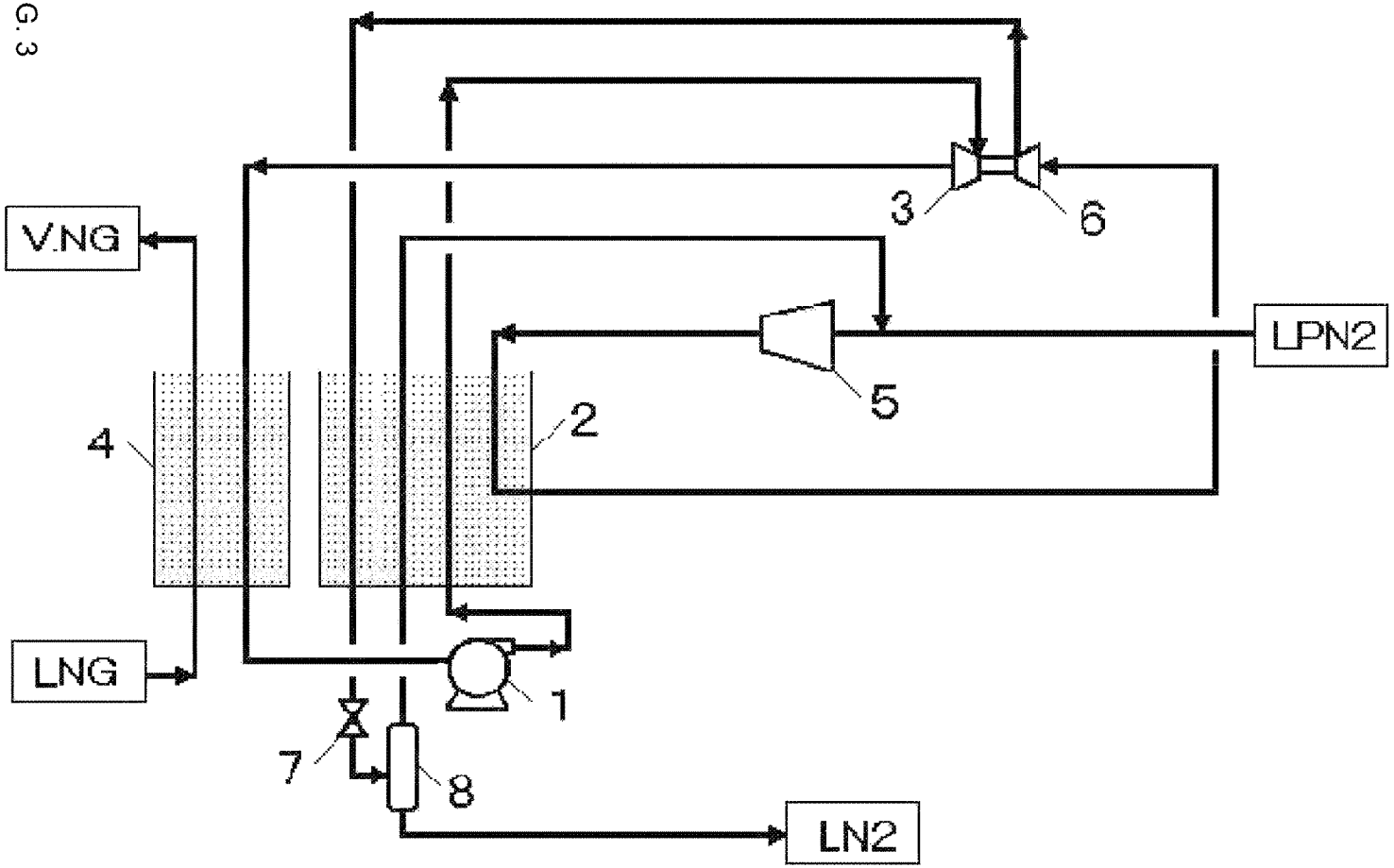
FIG. 3 is a schematic view exemplifying another mode of the first exemplary structure of an apparatus for producing a liquefied fluid according to an embodiment of the present invention.

In other words, the low-temperature compressed fluid from the second compression device 6 is cooled in the second heat exchanger 4 and is subjected to pressure adjustment by the adjustment valve 7, and the liquefied component is subjected to gas-liquid separation in the gas-liquid separator 8 and extracted as a low-temperature liquefied component from the gas-liquid separator 8. At this time, when the material gas is, for example, ethane or propane having a comparatively higher boiling point than nitrogen or oxygen, the low-temperature compressed fluid can be liquefied by being guided into the first heat exchanger 2, as is exemplified in FIG. 3. This is because the temperature difference from the cold of the LNG is small, and the cold of the LNG sufficient for liquefaction can be transferred via the heat transfer medium when the source material is guided out from the first heat exchanger 2 and again guided into the first heat exchanger 2 in a compressed state. Also, in the case of "the pressure of the LNG">"the pressure of the material gas" (for example, about 50 bar), there is a possibility that the LNG may leak to the material gas side, so that the risk thereof can be evaded with such a structure.

Similarly as the specific example in the above-described present apparatus, a specific example will be assumed in which a mixture obtained by blending ethane and propane in an equal molar ratio as a major component, for example, is used as the heat transfer medium of the RC; LNG of about 6 MPa is guided into the second heat exchanger 4; and nitrogen gas is fed as a material gas. A material gas that has been guided at about 2.1 MPa into the first heat exchanger 2 becomes a low-temperature compressed nitrogen gas of about −90° C. and about 5 MPa by passing through the compressor 6. This low-temperature compressed nitrogen gas is further guided into the second heat exchanger 4 to be cooled to about −153° C. and then is expanded via the adjustment valve 7 to be cooled to about −179° C., whereafter the liquefied nitrogen gas mainly containing a liquefied component is guided into the gas-liquid separator 8. The liquefied component that has been subjected to gas-liquid separation in the gas-liquid separator 8 is extracted as a liquefied nitrogen gas of about −179° C. and about 0.05 MPa.

Similarly as in the verification test in the above-described present apparatus, a case in which a liquefied nitrogen gas was prepared using the present liquefaction apparatus was compared with a case in which a liquefied nitrogen gas was prepared using a conventional method, so as to verify the energy efficiency thereof. As will be described below, an improvement of about 25% or more could be achieved by using the present apparatus.

(i) A case in which a liquefied nitrogen gas was prepared using a conventional method LNG was supplied at 1 ton/h, and an energy of 0.28 $kWh/Nm^3$ was needed in preparing a liquefied nitrogen gas of about 0.05 MPa.

(ii) A case in which a liquefied nitrogen gas was prepared using the present method An energy of 0.21 $kWh/Nm^3$ was sufficient in preparing a liquefied nitrogen gas of about 0.05 MPa under the conditions of the specific example in the above-described present liquefaction apparatus.

(iii) When the two cases are compared, it has been found out that the electric power could be reduced by about 25%, from the following formula 1.

$$(0.28-0.21)/0.28=0.25 \quad \text{(formula 1)}$$

Figure 4:
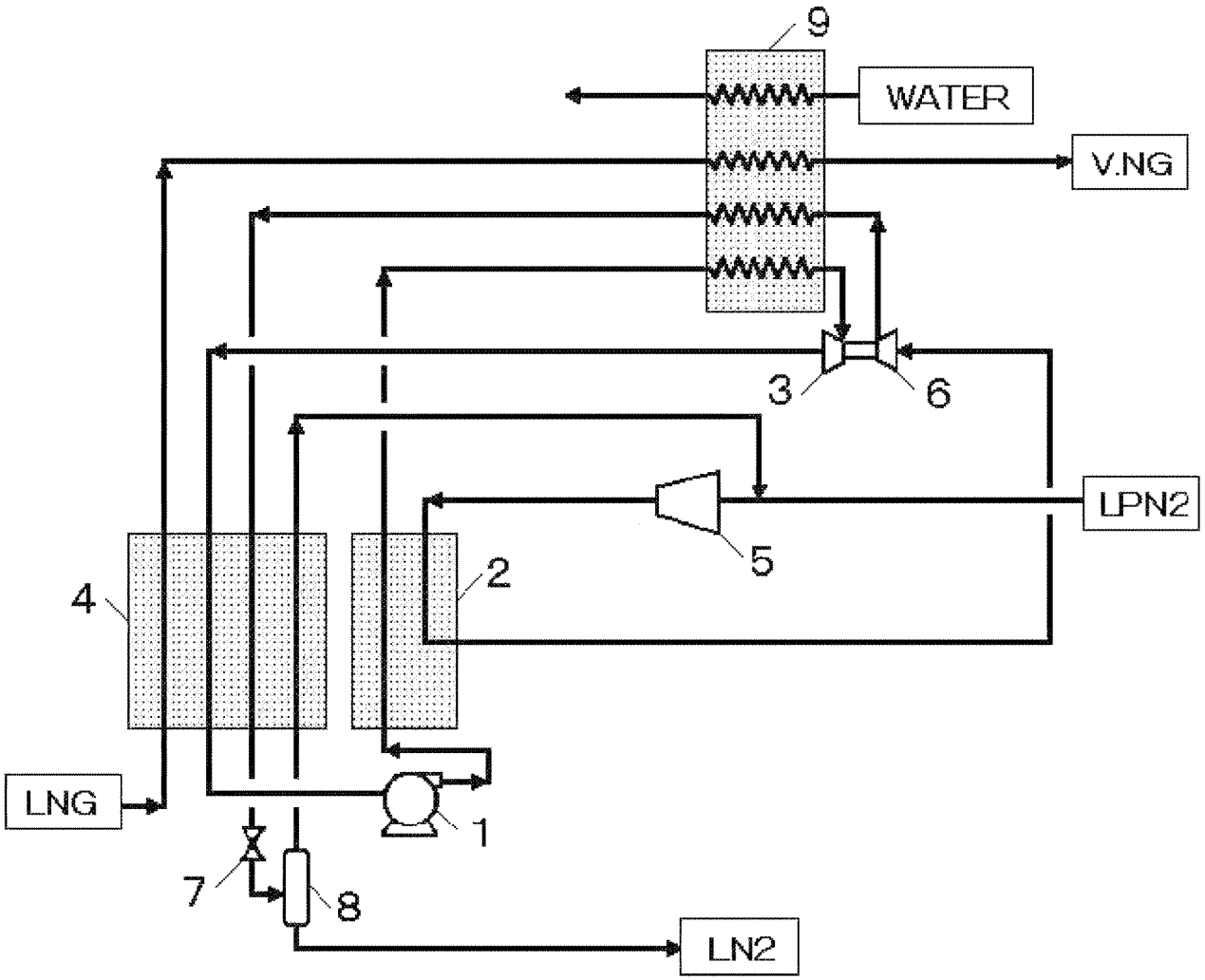
FIG. 4 is a schematic view illustrating the second exemplary structure of an apparatus for producing a liquefied fluid according to an embodiment of the present invention.

Another exemplary structure (second exemplary structure) of the present liquefaction apparatus will be schematically shown in FIG. 4. Similarly as in the first exemplary structure, the present liquefaction apparatus according to the second exemplary structure has a Rankine cycle system (RC), an adjustment valve 7, and a gas-liquid separator 8, wherein a third heat exchanger 9 is disposed in a (third) flow passageway through which the heat transfer medium from the first heat exchanger 2 is guided to the expansion device (turbine) 3, where the heat transfer medium, the liquefied natural gas from the second heat exchanger 4, and the low-temperature compressed fluid from the second compression device (compressor) 6 undergo heat exchange in the third heat exchanger 9. In addition to the functions in the first exemplary structure, the cold of the LNG can be used further more efficiently, and preparation of a liquefied fluid having a high energy efficiency can be carried out. Here, similarly as in the first exemplary structure, a structure in which the low-temperature compressed fluid can be liquefied by being guided into the first heat exchanger 2 can be applied.

In other words, in the third heat exchanger 9, the cold of the LNG can be used further more efficiently by using the residual cold of the LNG for cooling the heat transfer medium that has been heated in the first heat exchanger 2 and the low-temperature compressed fluid that has been compressed to have an increased heat quantity. Also, a structure in which cooling water is introduced in the third heat exchanger 9 will be exemplified here. Heat exchange with cold energy having a large heat capacity can be carried out, and quick transfer of hot heat can be achieved to the heat transfer medium, the liquefied natural gas, and the low-temperature compressed fluid. Even to transient fluctuation or the like at the time of starting or at the time of stopping, preliminary or auxiliary transfer of hot energy can be achieved to the heat transfer medium, the liquefied natural gas, and the low-temperature compressed fluid, whereby stable use of the cold of the LNG and stable energy efficiency can be ensured.

Figure 5:
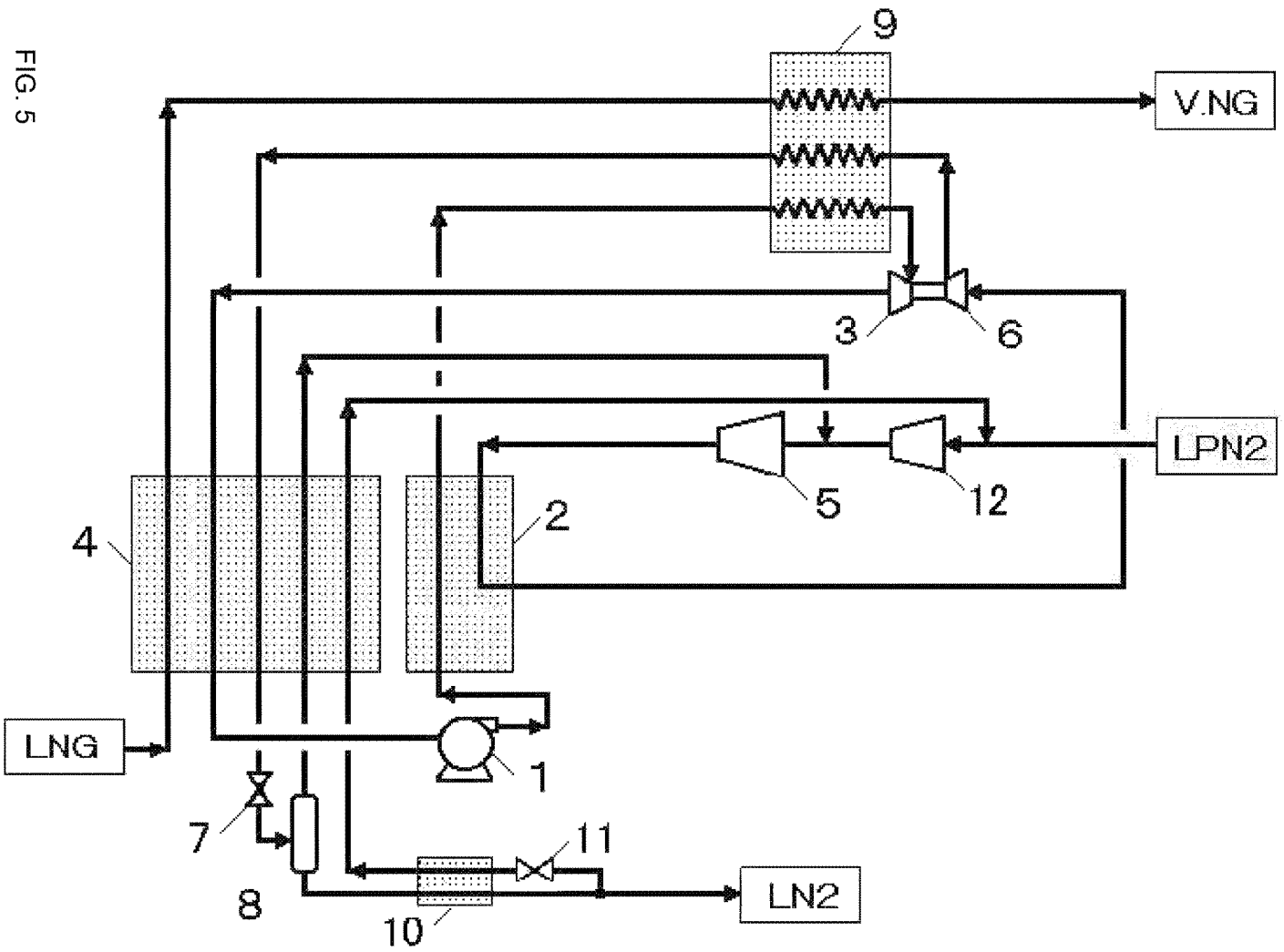
FIG. 5 is a schematic view illustrating the third exemplary structure of an apparatus for producing a liquefied fluid according to an embodiment of the present invention.

The third exemplary structure of the present liquefaction apparatus will be schematically shown in FIG. 5. In addition to the second exemplary structure, the present liquefaction apparatus according to the third exemplary structure is characterized in that first pressure-raising device (feed pump) 5, a first branching flow passageway S1, second pressure-raising device 10, and a second branching flow passageway S2 are disposed in a (fourth) flow passageway L5 through which the material gas is guided to the first heat exchanger 2; a fourth heat exchanger 11 and a third branching flow passageway S3 are disposed in a (fifth) flow passageway L8 through which the liquefied component from the gas-liquid separator 8 is guided; the apparatus has a (sixth) flow passageway L11 through which a gas component from the gas-liquid separator 8 is guided to the first branching flow passageway S1 via the second heat exchanger 4, and has a (seven) flow passageway L12 through which the liquefied component that has been branched at the third branching flow passageway S3 is guided to the second branching flow passageway S2 via the fourth heat exchanger 11 and the second heat exchanger 4, wherein the liquefied component from the gas-liquid separator 8 is extracted via the fourth heat exchanger 11. Supply of a liquefied fluid being stable and having a good energy efficiency has been enabled by disposing compressors in a plurality of stages as the material gas feeding device and by returning the liquefied fluid in a stable condition immediately before being extracted and mixing it with the material gas.

In the third exemplary structure, a structure will be exemplified in which a second adjustment valve 12 is disposed in the third branching flow passageway S3, and part of the liquefied fluid from the fourth heat exchanger 11 is again guided into the fourth heat exchanger 11 via the second adjustment valve 12. Though having a low pressure, a liquefied fluid having a further lower temperature is prepared by adiabatically expanding the low-temperature liquefied fluid with the second adjustment valve 12 and can be allowed to function as the cold in the fourth heat exchanger 11.

The temperature and the pressure of the gas or liquid in each flow passageway in the case in which liquefied nitrogen gas was prepared using the liquefaction apparatus according to the third exemplary structure were verified. The verification results are exemplified in Table 1.

TABLE 1

| | Flow passageway No. | | | | | |
|---|---|---|---|---|---|---|
| | L1 | L2 | L3 | L4 | L5 | L6 |
| Pressure (Bar) | 65.50 | 61.00 | 1.10 | 4.95 | 21.00 | 20.80 |
| Temperature (° C.) | −156 | −1 | 6 | 40 | 40 | −91 |

| | Flow passageway No. | | | | | |
|---|---|---|---|---|---|---|
| | L7 | L8 | L10 | L11 | L12 | L13 |
| Pressure (Bar) | 51.67 | 5.10 | 5.10 | 5.00 | 1.23 | 1.60 |
| Temperature (° C.) | −20 | −179 | −192 | −192 | −190 | −45 |

| | Flow passageway No. | | | | |
|---|---|---|---|---|---|
| | L14 | L15 | L16 | S2 | S1 |
| Pressure (Bar) | 1.50 | 19.00 | 18.50 | 1.10 | 4.95 |
| Temperature (° C.) | −115 | −114 | 30 | −31 | −88 |

Figure 6:
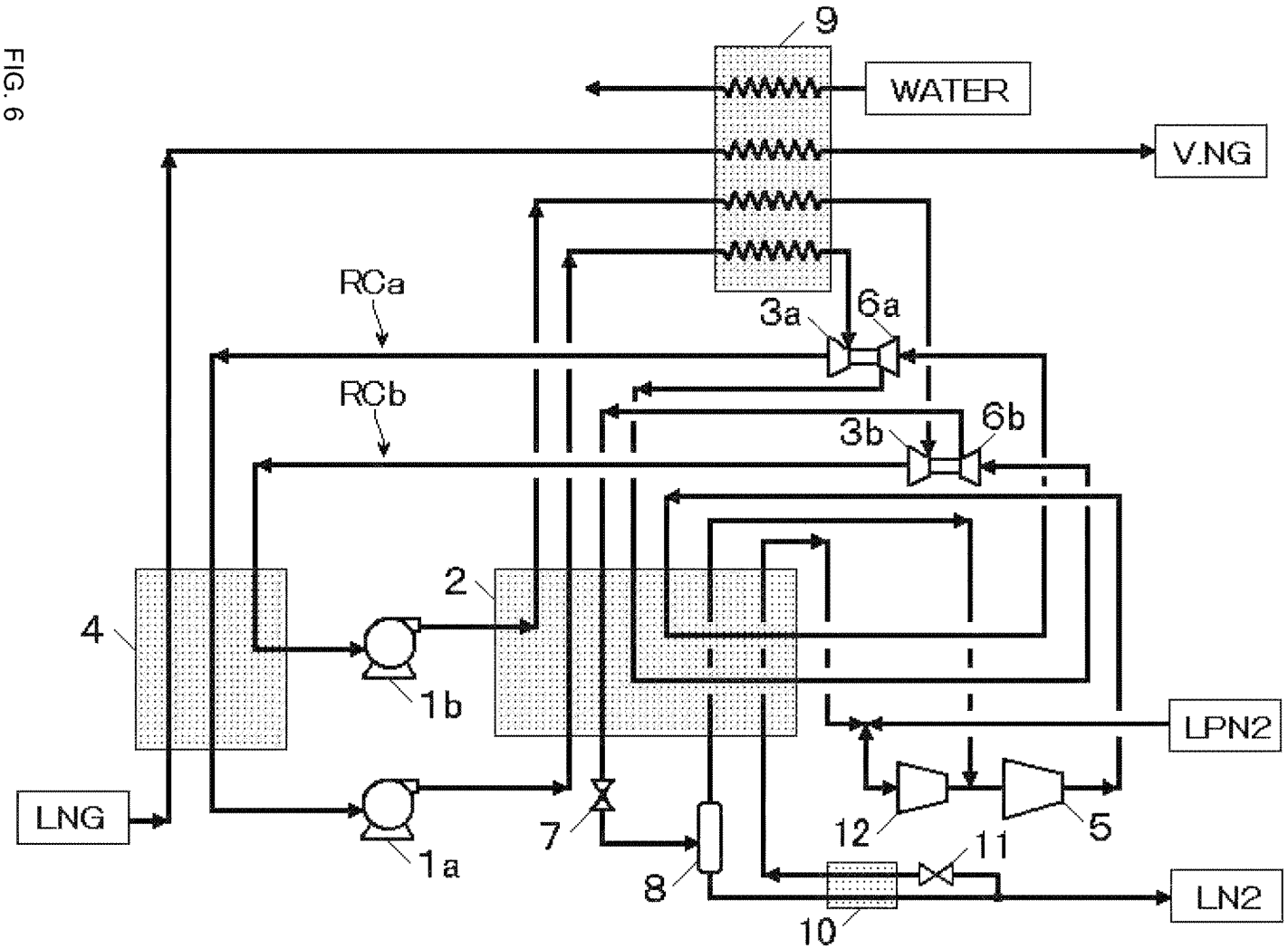
FIG. 6 is a schematic view illustrating the fourth exemplary structure of an apparatus for producing a liquefied fluid according to an embodiment of the present invention.
Figure 7:
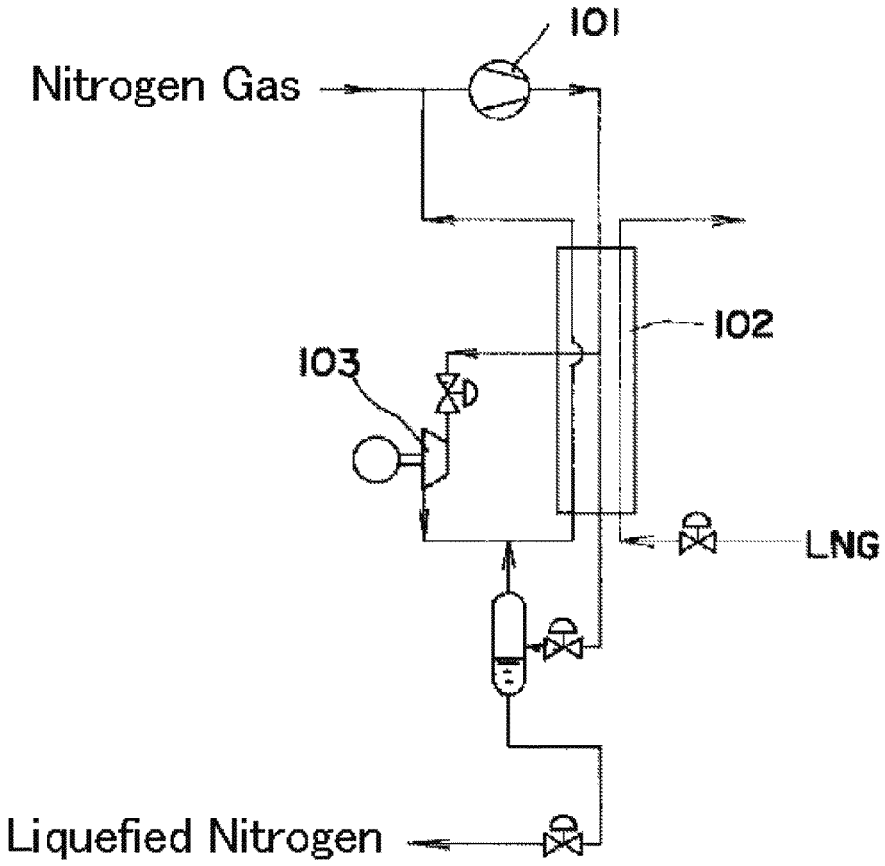
(Prior Art) FIG. 7
FIG. 7 is a schematic view illustrating an exemplary structure of a gas liquefying process according to a conventional art.

The fourth exemplary structure of the present liquefaction apparatus will be schematically shown in FIG. 6. In addition to the third exemplary structure, the present liquefaction apparatus according to the fourth exemplary structure is characterized in that the apparatus using a plurality of Rankine cycle systems comprising a plurality of heat transfer media having different boiling points or heat capacities, wherein the material gas from the first heat exchanger 2 is guided into the first heat exchanger 2 after being compressed by second compression device 6*a* that is coupled to the expansion device 3*a* involved in one Rankine cycle system RCa using a heat transfer medium having a low boiling point or a small heat capacity, and thereafter the material gas from the first heat exchanger 2 is guided into the first heat exchanger 2 after being compressed by second compression device 6*b* that is coupled to the expansion device 3*b* involved in another Rankine cycle system RCb using a heat transfer medium having a high boiling point or a large heat capacity. Supply of a liquefied fluid being stable and having a good energy efficiency has been enabled by constructing with a plurality of Rankine cycle systems using a plurality of heat transfer media having different boiling points or heat capacities with respect to the heat transfer media that are involved in transferring the cold of the LNG and by adjusting the control elements that can be easily controlled, such as the flow rate and the pressure of the heat transfer media in each Rankine cycle system, with respect to the fluctuating elements such as the supply amount and the supply pressure of the liquefied fluid.

The plurality of heat transfer media having different boiling points or heat capacities as referred to herein include not only a case in which the substances themselves are different and a case in which the substances constituting the mixtures or compounds are different but also a case in which the composition of the mixture of a plurality of substances is different. For example, two Rankine cycle systems having different characteristics can be constructed by forming one heat transfer medium with a mixture of 20% of methane, 40% of ethane, and 40% of propane and forming the other heat transfer medium with a mixture of 2% of methane, 49% of ethane, and 49% of propane. By a combination thereof, transfer of the cold or the cold energy that matches with various fluctuating elements can be achieved, and efficient transfer of energy to the compression device coupled with the expansion device can be achieved.

Also, when heat transfer media having different components are used, a heat transfer function of a further wider range can be formed. In other words, there is a restriction on the temperature band in which the cold of the LNG can be used because of the relationship between the temperature of the cold of the LNG and the boiling point of the material gas or the temperature of the compressed gas (fluid) as described above, so that the cold of the LNG can be used in a plurality of temperature bands by arranging one Rankine cycle system RCa and another Rankine cycle system RCb in series as in the fourth exemplary structure. For example, the cold energy of the LNG can be thermally transferred in a plurality of temperature bands by using a mixture of "methane+ethane+propane" in one Rankine cycle system RCa and using a mixture of "ethane+propane+butane" in another Rankine cycle system RCb. The cold energy of the LNG can be efficiently used by arranging one Rankine cycle system RCa and another Rankine cycle system RCb in series as in the fourth exemplary structure and by using the cold energy of the LNG, for example, in a range of −150 to −100° C. in the one Rankine cycle system RCa and using the cold energy of the LNG, for example, in a range of −150 to −100° C. in the other Rankine cycle system RCb. Also, when this is used as an energy for compressing the nitrogen gas, the energy (consumed electric power) needed per liquefied nitrogen production amount can be greatly reduced.

As shown above, each exemplary structure has been described on the basis of each descriptive view; however, the present apparatus or the present liquefaction apparatus is not limited to these but is constructed with a wider concept including a combination of the constituent elements thereof or a combination with other related known constituent elements.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. An apparatus for cooling and compressing a fluid to produce a low-temperature compressed fluid, the apparatus using a first Rankine cycle system and a second Rankine cycle system, the first Rankine cycle system comprising:

a first heat transfer medium compression device configured to adiabatically compress a first heat transfer medium thereby forming a compressed first heat transfer medium;

a first heat exchanger configured to provide constant-pressure heating to the compressed first heat transfer medium thereby forming a first heated heat transfer medium;

a first expansion device configured to adiabatically expand the first heated heat transfer medium thereby forming a first expanded heat transfer medium;

a second heat exchanger configured to provide constant-pressure cooling to the first expanded heat transfer medium thereby forming the first heat transfer medium;

a first flow passageway configured to guide the first heat transfer medium from the second heat exchanger to the first heat transfer medium compression device; and a first material gas compression device that is coupled to the first expansion device;

wherein the second Rankine cycle system comprises:

a second heat transfer medium compression device configured to adiabatically compress a second heat transfer medium thereby forming a compressed second heat transfer medium;

the first heat exchanger configured to provide constant-pressure heating to the compressed second heat transfer medium thereby forming a second heated heat transfer medium;

a second expansion device configured to adiabatically expand the second heated heat transfer medium thereby forming a second expanded heat transfer medium;

the second heat exchanger configured to provide constant-pressure cooling to the second expanded heat transfer medium thereby forming the second heat transfer medium;

a second flow passageway configured to guide the second heat transfer medium from the second heat exchanger to the second heat transfer medium compression device; and a second material gas compression device that is coupled to the second expansion device, wherein the first heat transfer medium and the second heat transfer medium have different boiling points or heat capacities, wherein, at the second heat exchanger, a low-temperature liquefied natural gas (LNG) transfers heat with the first expanded heat transfer medium and the second expanded heat transfer medium, wherein, at the first heat exchanger, a material gas transfers heat with the compressed first heat transfer medium and the compressed second heat transfer medium to produce a low-temperature fluid from the material gas, wherein the second material gas compression device is configured to compress the low-temperature fluid, wherein the material gas from the first heat exchanger is guided into the first heat exchanger after being compressed by the first material gas compression device and thereafter the material gas from the first heat exchanger is guided into the first heat exchanger after being compressed by the second material gas compression device.

2. A method for cooling and compressing a fluid to produce a low-temperature compressed fluid, the method comprising the steps of:

providing the apparatus as claimed in claim 1;

heating the low-temperature LNG against the first expanded heat transfer medium and the second expanded heat transfer medium in the second heat exchanger to produce a warmed natural gas stream, the first heat transfer medium and the second heat transfer medium;

compressing the first heat transfer medium in the first heat transfer medium compression device to form the compressed first heat transfer medium;

compressing the second heat transfer medium in the second heat transfer medium compression device to form the compressed second heat transfer medium; and heating the compressed first heat transfer medium and the compressed second heat transfer medium in the first heat exchanger against the material gas to produce the first heated heat transfer material, the second heated heat transfer material, and the low-temperature fluid from the material gas.

* * * * *